US008579075B2

(12) United States Patent
Brittingham et al.

(10) Patent No.: US 8,579,075 B2
(45) Date of Patent: Nov. 12, 2013

(54) BLACKOUT SILENCER

(75) Inventors: Kevin Tyson Brittingham, Dacula, GA (US); Michael Leighton Smith, Alpharetta, GA (US)

(73) Assignee: Advanced Armament Corp., LLC, Madison, NC (US)

( * ) Notice: Subject to any disclaimer, the term of this patent is extended or adjusted under 35 U.S.C. 154(b) by 1141 days.

(21) Appl. No.: 12/075,746

(22) Filed: Mar. 13, 2008

(65) Prior Publication Data

US 2012/0145478 A1 Jun. 14, 2012

(51) Int. Cl.
*F41A 21/00* (2006.01)

(52) U.S. Cl.
USPC ..... 181/223; 181/224; 89/14.4

(58) Field of Classification Search
USPC ..... 181/223, 224; 89/14.4
See application file for complete search history.

(56) References Cited

U.S. PATENT DOCUMENTS

| | | | | |
|---|---|---|---|---|
| 785,974 | A | 3/1905 | McClean | |
| 863,342 | A | 8/1907 | Alber | |
| 1,017,003 | A * | 2/1912 | Kenney | 181/223 |
| 1,173,687 | A | 2/1916 | Thompson | |
| 1,342,978 | A | 6/1920 | Young | |
| 1,413,903 | A | 4/1922 | Czegka | |
| 1,462,158 | A | 7/1923 | Wildner | |
| 1,525,846 | A | 2/1925 | Wurtzebach | |
| 1,605,864 | A | 11/1926 | Steinegger | |
| 1,667,186 | A | 4/1928 | Bluehdorn | |
| 1,770,471 | A | 7/1930 | Hatcher | |
| 1,773,443 | A | 8/1930 | Wilman | |
| 2,016,226 | A | 10/1935 | Clausen | |
| 2,058,897 | A | 10/1936 | Marek | |
| 2,124,075 | A | 7/1938 | Moore | |
| 2,315,207 | A | 3/1943 | Janecek et al. | |
| D143,022 | S | 11/1945 | Norman | |
| 2,503,491 | A | 4/1950 | Janz | |
| 2,663,410 | A | 12/1953 | Kessler | |
| 2,748,662 | A | 6/1956 | Simpson | |
| 2,791,944 | A | 5/1957 | Harvey | |
| 2,792,760 | A | 5/1957 | Hammer | |
| 2,870,679 | A | 1/1959 | Collins | |
| 2,883,781 | A | 4/1959 | Harvey | |
| 2,895,383 | A | 7/1959 | Reed | |
| 2,900,875 | A | 8/1959 | Fergus et al. | |
| 2,941,450 | A | 6/1960 | Ray et al. | |

(Continued)

FOREIGN PATENT DOCUMENTS

DE 2229071 11/1973

OTHER PUBLICATIONS

Silencer talk forum posting Dec. 3,2005. www.silencertests.com/forum/viewtopic.php?f=10&t=1310.*

(Continued)

*Primary Examiner* — Forrest M Phillips
(74) *Attorney, Agent, or Firm* — Womble Carlyle Sandridge & Rice, LLP

(57) ABSTRACT

A silencer for a firearm which incorporates a cylindrical housing, front end cap, mean of attachment to the muzzle of a firearm, spacers and an improved cone baffle design. The proposed device incorporates a novel cone baffle design which uses concave flutes to increase surface area and thereby sound reduction. The geometry of this new cone baffle minimizes the weight of a silencer, maximizes internal volume, and effectively reduces sound and flash which are the result of a discharging firearm.

21 Claims, 3 Drawing Sheets

(56) References Cited

U.S. PATENT DOCUMENTS

| | | | | |
|---|---|---|---|---|
| 3,020,807 | A | 2/1962 | Hailston et al. | |
| 3,051,057 | A | 8/1962 | Ivy | |
| 3,114,289 | A | 12/1963 | Aulabaugh | |
| 3,164,060 | A | 1/1965 | Dahl | |
| 3,385,164 | A | 5/1968 | Walther et al. | |
| 3,483,794 | A | 12/1969 | Packard | |
| 3,500,955 | A | 3/1970 | Werbell | |
| 3,667,570 | A | 6/1972 | WerBell, III | |
| 3,677,132 | A | 7/1972 | Plenge | |
| 3,698,747 | A | 10/1972 | Wing et al. | |
| 3,732,776 | A | 5/1973 | Snodgrass | |
| 3,744,370 | A | 7/1973 | Snodgrass | |
| 3,748,956 | A * | 7/1973 | Hubner | 89/14.4 |
| 3,766,822 | A | 10/1973 | Sophinos | |
| 3,786,895 | A | 1/1974 | Perrine | |
| 3,888,331 | A | 6/1975 | Wang | |
| 3,968,727 | A | 7/1976 | Hyytinen | |
| 4,159,552 | A | 7/1979 | Berecz | |
| 4,233,737 | A | 11/1980 | Poehlmann | |
| 4,291,610 | A | 9/1981 | Waiser | |
| 4,384,507 | A | 5/1983 | Finn | |
| 4,426,248 | A | 1/1984 | Jackson | |
| 4,433,611 | A | 2/1984 | Baumann | |
| 4,499,811 | A | 2/1985 | Kaste | |
| 4,510,843 | A | 4/1985 | Rabatin | |
| 4,530,417 | A | 7/1985 | Daniel | |
| 4,570,529 | A | 2/1986 | A'Costa | |
| 4,576,083 | A | 3/1986 | Seberger, Jr. | |
| 4,579,034 | A | 4/1986 | Holloway | |
| 4,584,924 | A | 4/1986 | Taguchi | |
| 4,588,043 | A | 5/1986 | Finn | |
| 4,599,934 | A | 7/1986 | Palmer | |
| D285,238 | S | 8/1986 | Cellini | |
| 4,643,272 | A | 2/1987 | Gaffrig | |
| 4,679,597 | A | 7/1987 | Stein | |
| 4,702,146 | A | 10/1987 | Ikeda et al. | |
| 4,716,809 | A | 1/1988 | A'Costa | |
| 4,756,677 | A | 7/1988 | Hribernik et al. | |
| 4,785,909 | A | 11/1988 | Young | |
| 4,893,544 | A | 1/1990 | Hawley et al. | |
| 4,907,488 | A | 3/1990 | Seberger | |
| 4,907,489 | A | 3/1990 | Teague | |
| 4,930,396 | A | 6/1990 | Johnson | |
| 4,939,977 | A | 7/1990 | Stroup | |
| 4,971,489 | A | 11/1990 | Womack | |
| 4,974,489 | A | 12/1990 | Fishbaugh | |
| 5,029,512 | A * | 7/1991 | Latka | 89/14.4 |
| 5,092,223 | A | 3/1992 | Hudson | |
| 5,136,924 | A | 8/1992 | Forster et al. | |
| 5,140,893 | A | 8/1992 | Leiter | |
| 5,164,535 | A | 11/1992 | Leasure | |
| D349,147 | S | 7/1994 | Gwinn, Jr. | |
| 5,325,758 | A | 7/1994 | Compton et al. | |
| 5,356,183 | A | 10/1994 | Cole | |
| 5,438,907 | A | 8/1995 | Reynolds et al. | |
| 5,476,026 | A | 12/1995 | McFarlin | |
| 5,476,028 | A | 12/1995 | Seberger | |
| 5,559,302 | A | 9/1996 | Latka | |
| 5,596,161 | A | 1/1997 | Sommers | |
| 5,611,409 | A | 3/1997 | Arseneau | |
| 5,631,438 | A | 5/1997 | Martel | |
| 5,679,916 | A | 10/1997 | Weichert | |
| 5,689,907 | A | 11/1997 | Cooley | |
| 5,737,835 | A | 4/1998 | Murata | |
| 5,773,746 | A | 6/1998 | Vaden | |
| D415,812 | S * | 10/1999 | Andrews et al. | D22/108 |
| D415,813 | S | 10/1999 | O'Quinn et al. | |
| 5,983,772 | A | 11/1999 | Reynolds et al. | |
| 6,026,728 | A | 2/2000 | Gühring et al. | |
| 6,079,311 | A | 6/2000 | O'Quinn et al. | |
| D435,884 | S | 1/2001 | Dehaan | |
| 6,176,032 | B1 | 1/2001 | Cohen et al. | |
| 6,289,623 | B1 | 9/2001 | Cohen et al. | |
| 6,308,609 | B1 | 10/2001 | Davies | |
| 6,324,780 | B1 | 12/2001 | Behling | |
| 6,374,718 | B1 | 4/2002 | Rescigno et al. | |
| 6,385,891 | B1 | 5/2002 | Rabatin | |
| 6,412,389 | B2 | 7/2002 | Fluhr | |
| 6,425,310 | B1 | 7/2002 | Champion | |
| 6,575,074 | B1 * | 6/2003 | Gaddini | 89/14.4 |
| 6,595,099 | B1 | 7/2003 | Olson et al. | |
| 6,701,820 | B2 | 3/2004 | Fluhr | |
| 6,722,254 | B1 | 4/2004 | Davies | |
| 6,796,214 | B2 | 9/2004 | Hausken et al. | |
| 6,796,403 | B1 | 9/2004 | Laughlin | |
| 6,810,615 | B2 | 11/2004 | Hermanson et al. | |
| 6,820,530 | B2 | 11/2004 | Vais | |
| 6,837,139 | B2 | 1/2005 | Meyers | |
| 6,889,593 | B2 | 5/2005 | Gühring et al. | |
| 6,905,297 | B2 | 6/2005 | DiStasio et al. | |
| 6,923,292 | B2 | 8/2005 | Woods et al. | |
| 6,931,776 | B2 | 8/2005 | Wagner et al. | |
| 6,948,415 | B2 | 9/2005 | Matthews et al. | |
| 6,973,863 | B1 | 12/2005 | Jones | |
| 7,059,235 | B2 | 6/2006 | Hanslick et al. | |
| 7,062,874 | B1 | 6/2006 | Smith | |
| 7,073,426 | B1 | 7/2006 | White | |
| 7,155,143 | B2 | 12/2006 | Miner et al. | |
| D542,877 | S | 5/2007 | Murello et al. | |
| 7,237,467 | B1 * | 7/2007 | Melton | 89/14.4 |
| 7,290,475 | B2 | 11/2007 | Fluhr | |
| 7,302,774 | B2 | 12/2007 | Meyers | |
| 7,308,967 | B1 | 12/2007 | Hoel | |
| 7,325,474 | B2 | 2/2008 | Yoshimura et al. | |
| 2005/0115394 | A1 | 6/2005 | Matthews et al. | |
| 2005/0126382 | A1 | 6/2005 | Yoshimura et al. | |
| 2006/0010750 | A1 | 1/2006 | Yoshitaka | |
| 2006/0060076 | A1 | 3/2006 | Dueck et al. | |
| 2006/0243125 | A1 | 11/2006 | La France | |
| 2007/0095198 | A1 | 5/2007 | Dater et al. | |
| 2007/0107590 | A1 | 5/2007 | Silvers | |
| 2007/0137084 | A1 | 6/2007 | Laney et al. | |
| 2007/0266844 | A1 | 11/2007 | Dueck | |

OTHER PUBLICATIONS

Paulson, et al., Silencer History and Performances, vol. 2 COB, Assault Rifles and Sniper Technology (2002), p. 350, Table 7.3.

Paulson; AAC's Evolution-9, Suppressing hard-to-silence 9mm pistols including Beretta 92F; Special Weapons for Military and Police; cover and pp. 24-27; Fall 2002 issue; Harris Publications.

Paulson; ".223 Silencers: Where we've been, where we are, where we're going!"; Special Weapons; pp. 68-75; Aug. 2004.

Paulson; AAC GLOCK 9mm Suppressors, for GLOCK 17, 19, and 26 with AAC Evolution-9, Spider-2, Scorpion!; Combat Handguns; cover and pp. 34-39; Jun. 2006 issue; Harris Publications.

AAC Evolution-0.9MM Shootout and Pistol Trials, Oct. 12, 2007 http://www.silencerresearch.com/9mm_shootout_and_pistol_trials.htm and http://web.archive.org/web/*/http://www.silencer-research.com/9mm_shootout_and_pistol_trials.htm and http://web.archive.org/web/20071012150848/http://silencerresearch.com/9mm_shootout_and_pistol_trials.htm.

Multimount System. (2008) Retrieved from http://www.gem-tech.com/MultiMount.html.

* cited by examiner

BLACKOUT SILENCER

BACKGROUND OF THE INVENTION

1. Field of Invention

This invention relates in general to a sound suppressing device for reducing the muzzle blast and muzzle flash that occurs during the discharge of a firearm, and in particular, to such a device comprised of a type including an outer tube housing having at least one baffle which is conical in design.

2. Prior Art

Firearms when discharged produce a high intensity impulse sound. To reduce this high intensity impulse sound, many different silencers for firearms have been developed and patented. Combusting powder exiting the silencer produces a bright flash. Reducing or eliminating the flash is another goal of silencer manufacturers.

A wide variety of techniques have been developed and patented to produce effective silencers. The most efficient silencers have used combinations of baffles and varying sized expansion chambers, and/or liquid media to cool hot expanding gases. Regardless of the techniques used, the aim and intention of a silencer is to delay the exit of the propellant gases from the sound suppressor so that the resulting sound level is significantly reduced. Other concerns such as weight and point of impact shift resulting from the use of a silencer have also become issues of concern for silencer manufacturers.

Baffles have been used to achieve high levels of sound reduction in a variety of firearm silencers and the use of complex baffle, spacer combinations or monolithic baffle structures are known in the prior art. Symmetrical baffle designs have been used to reduce the negative effects on accuracy but at the expense of sound reduction. Baffles with asymmetric features which are positioned at an angle to the bore, or have slanted sidewalls have been used to achieve high levels of sound reduction. Cone or conical baffles have been used extensively over many years and a great many variations exist. Cone baffles are used to divide the silencer tube into chambers of various sizes where the expanding gases may expand and cool. Conical baffles may be of a truncated design, a frusto-conical design, or a conical baffle with a spiral vane on the exterior surface of the baffle. Many variations of the basic conical baffle are due to changes in the angle of the conical baffle and the addition of structures to the conical baffle to aid in improving the sound reduction level of the suppressor. Some of these structures have included a flat or curved flange positioned along the exterior surface of the cone.

U.S. Pat. No. 3,385,164 (Walther et al) discloses the use of conical baffles that feature a plurality of steps or multiple annular shoulders on the interior surface of a conical baffle. Also disclosed is the use of these multiple annular shoulders on the exterior and interior surfaces of a conical baffle. However, the use of these conical baffles with annular shoulders is in conjunction with other techniques. These conical baffles are positioned and only used in the area of the suppressor closest to the muzzle exit of the suppressor. This particular baffle design is also heavy and does not predict the redirection of gases which is achieved with vertical flutes.

One variation of the baffled sound suppressor is known as the coaxial suppressor. One version of the coaxial suppressor uses baffles that are separated by reduced diameter spacers, that are concentric to the bore of the suppressor with the spacers being ported to allow venting of the propellant gases to the outer expansion chamber. Another version of the coaxial suppressor uses a reduced diameter housing containing baffles and spacers, and this is positioned concentrically within an outer housing. Porting of the inner housing allows for venting of the gases to the outer expansion chamber. U.S. Pat. No. 4,576,083 (Seberger) features the use of reduced diameter coaxial spacer elements that are ported between groups of conical baffles. The baffles themselves have conventional spacer elements between each baffle. Each baffle is also ported at varying positions. U.S. Pat. No. 6,575,074 (Gaddini) features baffles that have integral reduced diameter coaxial spacer elements, and these are vented in a specific manner, dependent upon the caliber of the host firearm. The baffle featured in the Gaddini patent has a small conical portion that fits within the reduced diameter coaxial spacer element when assembled. The bore aperture is provided with an elongated slot. The use of coaxial spacing with silencers results in a silencer significantly heavier than designs which do not utilize this method. When the spacer must act as a support wall for the baffle, without the support of the external housing wall the result is a thicker spacer which weighs more than would be necessary with designs that do not utilize coaxial spacing.

It is an object of the invention herein described to provide a firearm silencer which eliminates muzzle flash and substantially reduces the sound signature of the host firearm through the use of cone baffles with fluted surface structures and either symmetrical or asymmetrical cuts on the tip of each cone which in turn has minimal or no effect on the accuracy of the discharged projectile. The use of stampings allows for the incorporation of surface geometry not seen before. With proper alloy selection, the internal volume of a silencer is increased because the stamped cone baffles used in one embodiment of the herein disclosed invention are much thinner. This change used in conjunction with the novel surface structures results in weight reduction, increased sound reduction, and the virtual elimination of muzzle flash.

Additional objects, advantages, and novel features of the invention will be set forth in part in the description as follows, and in part will become apparent to those skilled in the art upon examination of the following, or may be learned by practice of the invention.

OBJECTS AND ADVANTAGES

Accordingly, several objects and advantages of the present invention are:

(a) To provide a conical baffle design, which when used as part of a silencer assembly, significantly reduces the impulse sound of a discharged firearm.

(b) To provide a conical baffle design that may be used as part of a silencer assembly to reduce or eliminate the muzzle flash which is the result of hot, expanding gases that follow as a result of a firearm being discharged.

(c) To provide vertical fluted surfaces on a conical baffle which increase surface area and therefore increase sound and flash reduction.

(d) To increase the internal volume of a silencer without increasing its external diameter thereby increasing its sound reduction capability.

Still further objects and advantages will become apparent from a consideration of the ensuing description and drawings.

SUMMARY

The present invention is a silencer for a firearm which is intended for reducing the sound and flash signature of the host firearm. The silencer comprises a cylindrical housing, a mount, with means for attachment to a firearm and to the cylindrical housing, a front end cap with means for attachment to the cylindrical housing, and at least one fluted conical baffle positioned within the housing and between the mount and front end cap of the silencer. Separate spacer elements having an external diameter less than or slightly less than the internal diameter of the cylindrical housing are positioned between the mount and front end cap of the silencer and the plurality of fluted conical baffles. These spacers provide support and positioning of the baffles within the cylindrical housing of the silencer. The circular front end cap of the silencer is provided with a circular hole therein for the projectile to pass through the front end of the silencer. Expansion chambers are formed between the mount and front end cap of the silencer and the baffles within the silencer.

In one embodiment, the silencer utilizes a plurality of conical baffles that are provided with a concentric hole for a discharged projectile to pass. The conical baffles are also provided with a plurality of flutes spaced evenly about the exterior of the baffles, the depth of these flutes is deepest at the center of the longitudinal path which they occupy on the exterior of the conical baffle.

In another embodiment, the silencer features a combination of conical baffles, with at least one baffle having a step. A step is produced on the apex of a conical baffle by removing half of the apex. This step redirects the expanding gasses gases from a discharging firearm effectively creating turbulence and increasing the sound and flash reduction of the herein described silencer.

DRAWINGS

The novel features believed to be characteristic of the invention, together with further advantages thereof, will be better understood from the following description considered in connection with the accompanying drawings in which one embodiment of the present invention is illustrated by way of example. It is to be expressly understood, however, that the drawings are for the purpose of illustration and description only and are not intended as a definition of the limits of the invention.

DETAILED DESCRIPTION

Figure 1:
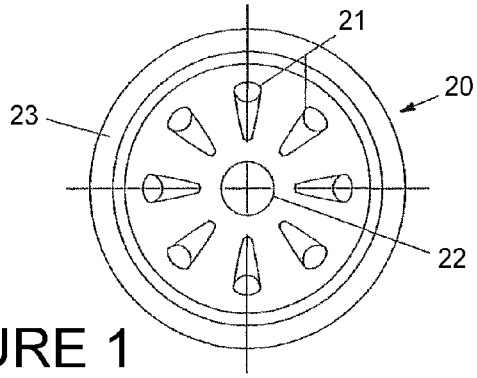
FIG. 1 shows a top plan view of a conical baffle in accordance with an embodiment of the present invention.
Figure 2:
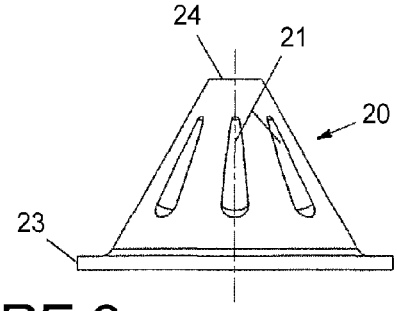
FIG. 2 shows a side plan view of the baffle of FIG. 1.
Figure 3:
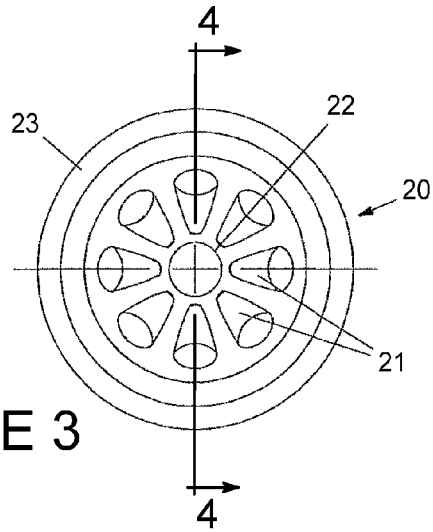
FIG. 3 shows a bottom view of the baffle of FIGS. 1-2.
Figure 4:
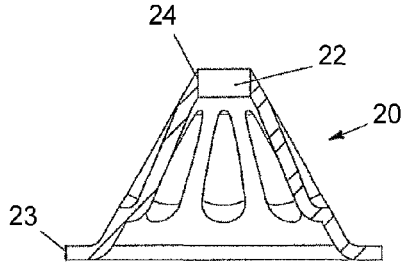
FIG. 4 shows a side sectional view of the baffle of FIG. 3 taken along line 4-4.
Figure 5:
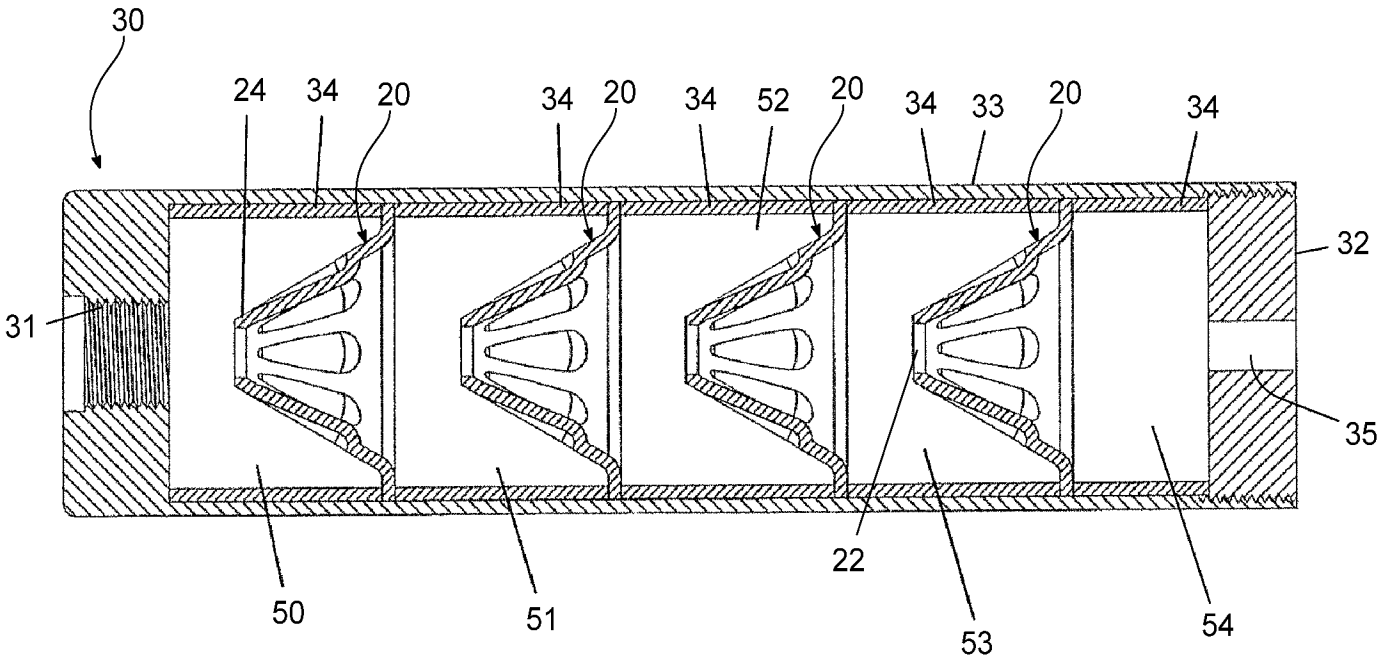
FIG. 5 shows a longitudinal sectional view of a silencer in accordance with an embodiment of the present invention.

Turning now to the drawings in which like reference characters indicate corresponding elements throughout the several views, attention is directed to FIG. 5 which illustrates an embodiment of a silencer 30. The silencer 30 may include a mount 31 which serves as a means to secure the silencer 30 to the host firearm 40. Mount 31 uses threads to removably secure the silencer 30, and is located on the proximal end of the silencer assembly. The distal front end of the silencer 30 may include a front end cap 32. A cylindrical tube 33 is utilized as a housing for the silencer 30. The internal volume of the silencer 30 is occupied by a combination of baffles 20 and spacers 34.

The front end cap 32 has a centrally located aperture 35 through which a bullet may pass.

In one embodiment, welds may be used to secure the mount 31 to the spacers 34, baffles 20, and front end cap 32. The tube 33 may then be slid over this sub assembly and welded to the mount 31 and front end cap 32. The baffles may be positioned so that the apex 24 of the baffle 20 is facing the proximal end of the silencer 30. A spacer 34 separates the mount 31, baffles 20, and front end cap 32 from each other. In another embodiment, threads may be used to assemble the silencer 30.

Figure 6:
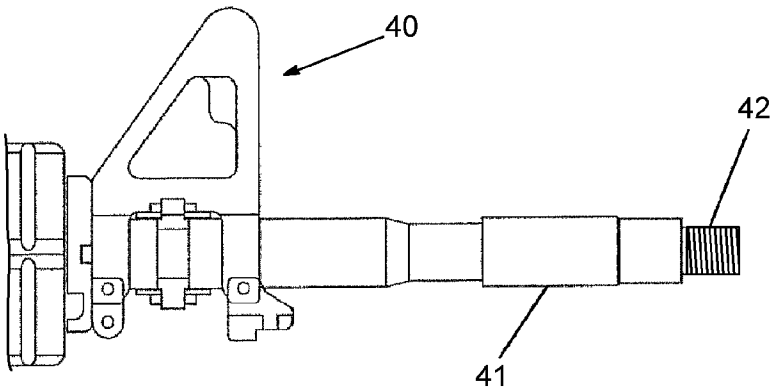
FIG. 6 shows a side view of a firearm with a threaded muzzle.

As used herein, the word "front" or "forward" or "distal" corresponds to the firing direction of the firearm (i.e., to the right as shown in FIGS. 5 & 6); "rear" or "rearward" or "back" or "proximal" corresponds to the direction opposite the firing direction of the firearm (i.e., to the left as shown in FIGS. 5 & 6); "longitudinal" means the direction along or parallel to the longitudinal axis of the silencer 30; and "transverse" means a direction perpendicular to the longitudinal direction.

In FIGS. 1-4, there are illustrated several views of one embodiment of the baffle 20 used in conjunction with the silencer 30. The exterior of the baffle 20 has a series of flutes 21 which are concave. The flutes 21 while numbering eight in FIGS. 1-4 should not be construed as representative of the only number or style of flutes 21 which may be used with the proposed baffle 20 design. The ledge 23 of the baffle 20 provides a surface which allows the baffles 20 to be supported by the spacers 34 within the silencer 30, as illustrated in FIG. 5. In one embodiment, the ledge 23 may also serve as a weld point during assembly of the silencer 30. Centrally located on the baffle 20 is a circular aperture 22 which serves as a passage point for a bullet being discharged from the host firearm 40 (shown in FIGS. 6-7).

In FIG. 6, there is illustrated a view of a firearm 40 with a barrel 41 and a threaded muzzle 42. The firearm 40 depicted is an M4 carbine which is in service with the US military. The principles of the present invention were tested through the use of a prototype silencer coupled to an M4 carbine as depicted in FIGS. 6-7.

Figure 7:
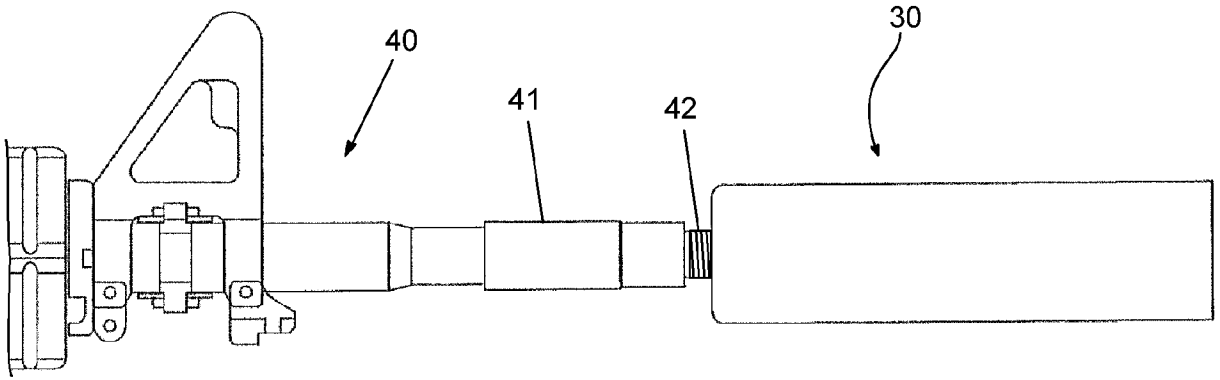
FIG. 7 shows a side view of the firearm of FIG. 6 coupled to a silencer in accordance with an embodiment of the present invention.

In FIG. 7, there is illustrated a view of a firearm 40 with the silencer 30 threadedly secured to the threaded muzzle 42 of the barrel 41.

Immediately following the discharge of a firearm 40 expanding gases from the barrel 41 pass through the mount 31 and into the initial expansion chamber 50, as formed between the mount 31 and the first baffle 20 as illustrated in FIG. 5. Gas passes through the aperture 35, provided on each of the baffles 20, to fill each successive expansion chamber 51-54 where the baffles 20, spacers 34, and tube 33 form the whole of the individual chambers. An expansion chamber 54 is sandwiched between a baffle 20 and the front end cap 32. This is the final chamber prior to the gases passing into the atmosphere. As the gases from the discharged firearm 40 pass over each baffle 20 into an expansion chamber 51-54 the flutes 21 on the baffles 20 increase turbulence and surface area forcing the gases to expend more energy to flow through the aperture 35 provided on the baffle 20 into the next expansion chamber 51-54. The conical shape of the baffles 20 causes the expanding gases being forced into the silencer 30 to initially bypass the baffles' 20 aperture 22 and fill the entire volume of the initial expansion chamber 50. As the gases expand in the initial expansion chamber 50 gas is forced to the sides of the aperture 22 and passes over the flutes 21. As the initial expansion chamber 50 is filled the gases then begin to travel back towards the aperture 22, thru it into the next expansion chamber 51-54. This process is repeated as the gases pass through each expansion chamber 51-53.

The number of baffles 20 may be selected to optimize the dwell time necessary to slow the unburned powder trapped in the expanding gases. Caliber of the host firearm 40 will be one of the most significant factors when determining the number of baffles 20 placed in the silencer 30. By slowing down the expanding gases and thereby the unburnt powder the silencer 30 is preventing the combustion of the powder once it hits the oxygen rich environment outside of the silencer 30. Muzzle flash and sound are reduced by preventing said unburnt powder from combusting.

Conclusion, Ramifications, and Scope

Accordingly, the reader will see that, according to the invention, I have provided an improved cone baffle 20 with a plurality of flutes 21 located about its periphery. I have afforded the user of a silencer equipped with said baffles improved noise reduction, flash suppression, and reduced weight of the overall package. This new improved fluted baffle 20 may be incorporated into virtually any silencer design. This baffle 20 design is not limited to any specific mounting system or method of assembly as the flutes 21 may be incorporated onto any baffle 20 which is conical in design.

While my above drawings and description contain many specificities, these should not be construed as limitations on the scope of the invention, but rather as an exemplification of one embodiment thereof. For example, my design is not limited to the use of four baffles 20 with five expansion chambers 50. The herein described design is merely one embodiment of the proposed invention. The number of baffles 20 used may be selected based on weight restrictions, caliber of firearm being silenced and ammunition choice for example. Another possibility is increasing the size of the expansion chambers 50-54 by lengthening the spacers 34 and the tube 33 to provide more internal volume for each expansion chamber 50-54. Increased volume provides more area for the expanding gases to be contained prior to exiting the silencer. The increased dwell time of the gases within the silencer 30 tube can aid in sound and flash reduction.

Accordingly, the scope of the invention should be determined not by the embodiments illustrated, but by the appended claims and their legal equivalents.

The invention claimed is:

1. A firearm silencer comprising:

a proximal end and a distal end, a longitudinal passageway configured to permit a projectile discharged from a firearm to enter at the proximal end, pass through the silencer, and exit at the distal end, a plurality of substantially conical baffles, situated along the passageway, each of the baffles being spaced from one another such that proximal and distal chambers are formed;

each baffle comprising:

an exterior surface facing the proximal chamber and narrowing in the direction of the proximal end, and an aperture at the proximal end of the exterior surface, the aperture positioned to form part of the passageway;

wherein the exterior surface of the baffle comprises at least one flute, the flute comprising a depression in the exterior surface which is concave when viewed from the proximal chamber and which increases a surface area and volume of the exterior surface of the baffle to create turbulence and increase sound reduction.

2. The silencer of claim 1, wherein the silencer includes a plurality of said baffles spaced between the proximal and distal ends.

3. The silencer of claim 2, further comprising a spacer positioned between two of the plurality of said baffles to separate them.

4. The silencer of claim 1, wherein at least one baffle includes a plurality of said flutes.

5. The silencer of claim 1, wherein the flute is a lengthened depression that runs substantially along the exterior surface in a direction defined between the aperture and a distal edge of the exterior surface.

6. The silencer of claim 5, wherein the exterior surface of the baffle comprises a series of flutes evenly spaced circumferentially around the exterior surface.

7. The silencer of claim 1, wherein the baffle further comprises an interior surface facing the distal chamber, the interior surface comprising at least one convex bulge, each bulge corresponding to a concave flute in the exterior surface.

8. The silencer of claim 7, further comprising a plurality of spacers disposed within the outer housing, at least one of the plurality of spacers positioned to separate the baffles from each other along the longitudinal axis.

9. The silencer of claim 1, wherein the aperture includes an edge that is substantially asymmetrical so as to increase turbulence in fluid flow near the aperture.

10. The silencer of claim 1 wherein the at least one flute is larger at a first end than a second end, the depression forming a concave portion at the first end, the concave portion forming on a surface area within the conical baffle.

11. A baffle for use in a firearm silencer, comprising:

a substantially conical wall having first and second ends, an apex portion with an aperture formed therein configured to allow passage of a projectile therethrough, a peripheral edge, and interior and exterior surfaces;

the exterior surface including at least one flute, the flute comprising a depression in the exterior surface which is spaced from the first and second ends and which is concave when viewed from upstream of the exterior surface, and which increases a surface area and volume of the exterior surface, creating turbulence and increasing sound reduction.

12. The baffle of claim 11, comprising a plurality of flutes.

13. The baffle of claim 11, wherein the flute is a lengthened depression that runs substantially along the exterior surface in a direction defined between the aperture portion and the peripheral edge.

14. The baffle of claim 12, wherein the exterior surface of the baffle comprises at least five of said flutes, and wherein the flutes are evenly spaced circumferentially around the exterior surface.

15. The baffle of claim 11, wherein the interior surface comprises at least one convex bulge, each bulge corresponding to a concave flute in the exterior surface.

16. The baffle of claim 11, wherein the aperture includes an edge that is substantially asymmetrical so as to increase turbulence in fluid flow near the aperture.

17. A method of forming a baffle for a firearm silencer, comprising:

stamping a material to form a conical baffle comprising: first and second ends, an apex portion, an interior surface, and a tapering exterior surface, the exterior surface including at least one concave flute, the flute comprising a depression in the exterior surface which is spaced form the first and second ends and which is concave when viewed from upstream of the exterior surface of the baffle and which increases a surface area of the exterior surface of the baffle sufficient to cause an increase in turbulence of gases passing over the exterior surface of the baffle, increasing sound reduction; and forming an aperture at the apex portion, the aperture configured to allow passage of a projectile therethrough.

18. The method of claim 17, wherein the aperture includes an edge that is substantially asymmetrical so as to increase turbulence in fluid flow near the aperture.

19. The silencer of claim 8, wherein the plurality of spaces are arranged along and in contact with an inner surface of the outer housing along an entire length of the spacer.

20. The baffle of claim 11, wherein the at least one flute is larger at a first end than a second end, the depression forming a concave portion at the first end, the concave portion forming a surface area within the conical baffle.

21. The baffle of claim 11, wherein the flute comprises a depression in the exterior surface which is a concave portion that forms an area of the exterior surface and the concave portion projecting towards an interior volume defined by the substantially conical wall.

* * * * *